US012624844B2

(12) United States Patent
Park et al.

(10) Patent No.: US 12,624,844 B2
(45) Date of Patent: May 12, 2026

(54) AIR HEATING APPARATUS

(71) Applicant: KYUNGDONG NAVIEN CO., LTD., Pyeongtaek-si (KR)

(72) Inventors: Jun Kyu Park, Seoul (KR); Dong Hwan Kim, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 441 days.

(21) Appl. No.: 18/205,136

(22) Filed: Jun. 2, 2023

(65) Prior Publication Data

US 2024/0060654 A1 Feb. 22, 2024

(30) Foreign Application Priority Data

Aug. 17, 2022 (KR) ..... 10-2022-0102753

(51) Int. Cl.

| | |
|---|---|
| ***F24D 11/00*** | (2022.01) |
| ***F24H 6/00*** | (2022.01) |
| ***F24H 15/223*** | (2022.01) |
| ***F24H 15/238*** | (2022.01) |
| ***F24H 15/32*** | (2022.01) |

(52) U.S. Cl.

CPC ..... *F24D 11/006* (2013.01); *F24H 6/00* (2013.01); *F24H 15/223* (2022.01); *F24H 15/238* (2022.01); *F24H 15/32* (2022.01)

(58) Field of Classification Search

None

See application file for complete search history.

(56) References Cited

U.S. PATENT DOCUMENTS

| | | | | |
|---|---|---|---|---|
| 7,040,108 | B1 * | 5/2006 | Flammang | F24D 11/0214 62/238.6 |
| 2008/0023961 | A1 * | 1/2008 | Cho | F24D 18/00 62/324.1 |
| 2018/0205097 | A1 * | 7/2018 | Park | H01M 8/04067 |
| 2024/0060654 | A1 * | 2/2024 | Park | F24D 11/006 |

* cited by examiner

*Primary Examiner* — Ko-Wei Lin

(74) *Attorney, Agent, or Firm* — ALG Intellectual Property, LLC

(57) ABSTRACT

Disclosed is an air heating apparatus including an expansion tank that preserves water, a water heater that receives heat from a combustion gas generated through a combustion reaction to heat the water, a heating heat exchanger that receives the water heated by the water heater and exchange heat with air that is to be discharged for heating, a fan that sends the air to the heating heat exchanger, a circulation supply passage that connects the expansion tank, the water heater, and the heating heat exchanger to guide the water in the expansion tank to the heating heat exchanger via the water heater, a circulation recovery passage formed to connect the heating heat exchanger and the expansion tank to guide the water that exchanged heat with the air to the expansion tank, and a hot water heating passage.

15 Claims, 12 Drawing Sheets

<Prior Art>

AIR HEATING APPARATUS

CROSS-REFERENCE TO RELATED APPLICATION

This application claims the benefit of priority to Korean Patent Application No. 10-2022-0102753, filed in the Korean Intellectual Property Office on Aug. 17, 2022, the entire contents of which are incorporated herein by reference.

TECHNICAL FIELD

The present disclosure relates to an air heating apparatus.

BACKGROUND

An air conditioning system for heating an interior of a room in winter seasons may provide heating in a scheme, in which heat generated by burning a fuel is transferred to air and the heated air is distributed to rooms. FIG. 1 is a view conceptually illustrating an air conditioning system including a conventional air heating apparatus. The air heating apparatus may include an expansion tank 20', a water heater 30', a heating heat exchanger 40', and a fan 50'.

The conventional air conditioning system may be used only for interior heating because a medium that is finally heated by the combustion heat is air, and it is difficult for the air conditioning system to be used for heating hot water.

Accordingly, a hot water heating apparatus for heating hot water has to be separately provided such that hot water is used. Because separate ducts connected to the air heating apparatus and the hot water heating apparatus are necessary, an occupied space increases and it is disadvantageous in an aspect of a spatial utility, and installation costs increase.

SUMMARY

The present disclosure has been made to solve the above-mentioned problems occurring in the prior art while advantages achieved by the prior art are maintained intact.

An aspect of the present disclosure provides an air heating apparatus that may perform an interior heating function and a hot water heating function.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, an air heating apparatus includes an expansion tank that preserves water, a water heater that receives heat from a combustion gas generated through a combustion reaction to heat the water, a heating heat exchanger that receives the water heated by the water heater and exchanges heat with air that is to be discharged for heating, a fan that sends the air to the heating heat exchanger, a circulation supply passage that connects the expansion tank, the water heater, and the heating heat exchanger to guide the water in the expansion tank to the heating heat exchanger via the water heater, a circulation recovery passage formed to connect the heating heat exchanger and the expansion tank to guide the water that exchanged heat with the air to the expansion tank, and a hot water heating passage, one end of which is connected to a first point that is one point of the circulation supply passage, which is located on a downstream sider of the water heater, an opposite end of which is connected to a second point that is one point of the circulation recovery passage, and through which the water in the circulation supply passage that passed through the water heater is introduced.

As another example, the air heating apparatus may further include a valve part that opens and closes the hot water heating passage, and that opens and closes a downstream side of the first point.

As another example, the valve part may include a first valve disposed in the hot water heating passage and that opens and closes the hot water heating passage, and a second valve disposed between the first point of the circulation supply passage and the heating heat exchanger, and that opens and closes a downstream side of the first point.

As another example, opening degrees of the first valve and the second valve may be adjustable.

As another example, the air heating apparatus may further include a circulation pump disposed in the circulation supply passage between a downstream side of the expansion tank and an upstream side of the water heater, and that pumps the water in the circulation supply passage.

As another example, the air heating apparatus may further include a first flow rate measuring part disposed in the circulation supply passage between a downstream side of the circulation pump and the upstream side of the water heater, and that measures a flow rate of the water that passes through the circulation supply passage, and a second flow rate measuring part disposed in the circulation supply passage on the downstream side of the first point, and that measures a flow rate of the water that passes in the circulation supply passage on the downstream side of the first point.

As another example, the air heating apparatus may further include a first temperature measuring part disposed in the circulation supply passage between a downstream side of the circulation pump and the upstream side of the water heater, and that measures a temperature of the water that passes through the circulation supply passage, and a second temperature measuring part disposed in the circulation supply passage on the downstream side of the water heater and an upstream side of the first point, and that measures a temperature of the water that passes through the circulation supply passage.

As another example, the air heating apparatus may further include a third temperature measuring part disposed in the circulation recovery passage, and that measures a temperature of the water that passes through the circulation recovery passage.

As another example, the air heating apparatus may further include a controller electrically connected to the valve part, and that controls an operation of the valve part.

As another example, in a hot water mode, in which it is necessary to use hot water, the controller may control the first valve to open the hot water heating passage.

As another example, when, in a heating mode for heating an interior, the heating mode and the hot water mode, in which it is necessary to use the hot water, are performed together, the controller may control the second valve to decrease a flow rate of the water that flows to the downstream side of the first point.

As another example, the air heating apparatus may further include a hot water tank provided with a heating area of the hot water heating passage in an interior thereof, and in which the hot water is preserved, and a hot water temperature measuring part coupled to the hot water tank and electrically connected to the controller, and that delivers acquired information on a temperature of the hot water tank to the controller, and the controller may be configured to control the first valve and the second valve to control at least any one of an opening of the first valve or the second valve, based on a value obtained by comparing a temperature of the hot water, which is acquired by the hot water temperature measuring part, and a target hot water temperature.

As another example, the air heating apparatus may further include a hot water tank, in which hot water is preserved, and a heating area of the hot water heating passage may be disposed in the hot water tank to heat the hot water in the hot water tank.

As another example, the heating area may be formed to have a spiral shape that extends downwards.

As another example, an interior of the hot water tank and an interior of the hot water heating passage may not be communicated with each other.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
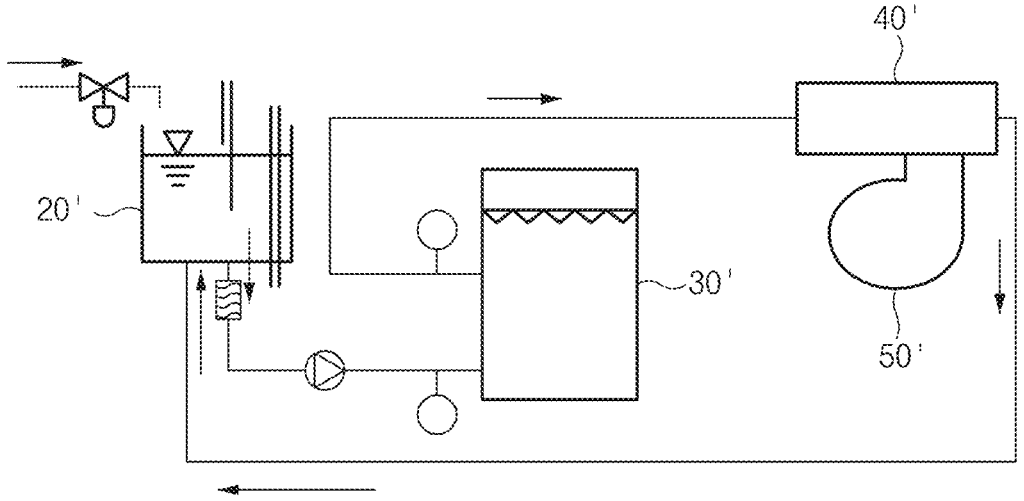
FIG. 1 is a view conceptually illustrating a conventional air heating apparatus.

Hereinafter, some embodiments of the present disclosure will be described in detail with reference to the exemplary drawings. Throughout the specification, it is noted that the same or like reference numerals denote the same or like components even though they are provided in different drawings. Further, in the following description of the present disclosure, a detailed description of known functions and configurations incorporated herein will be omitted when it may make the subject matter of the present disclosure rather unclear.

Referring to the drawings, an air heating apparatus according to an embodiment of the present disclosure may be installed in a house. The air heating apparatus may be connected to a duct connected to rooms of a house, and may perform heating by delivering the heated air to the rooms. The air may be introduced into the air heating apparatus from an outside of the house, and may return to the air heating apparatus via the rooms of the house. The air may be introduced into the air heating apparatus from the outside of the house, but in the specification of the present disclosure, a description will be made with an assumption that basically the air returns.

In the specification, a forward/rearward direction, a leftward/rightward direction, and an upward/downward direction are referred for convenience of description, and may be directions that are perpendicular to each other. However, the directions are determined relatively with respect to a direction, in which the air heating apparatus is arranged, and the upward/downward direction does not always mean a vertical direction.

Furthermore, the expression of passage used hereinafter may mean a pipe-shaped pipeline, in which a fluid flows therein, and components may be formed of various materials, such as a soft tube or a metal pipe, and may have various shapes.

Furthermore, the expressions of an upstream side and a downstream side in the present disclosure may be made with respect to a flow direction of a fluid. For example, when a fluid flows from a left side to a right side, the left side may correspond to an upstream side and the right side may correspond to a downstream side.

Figure 2:
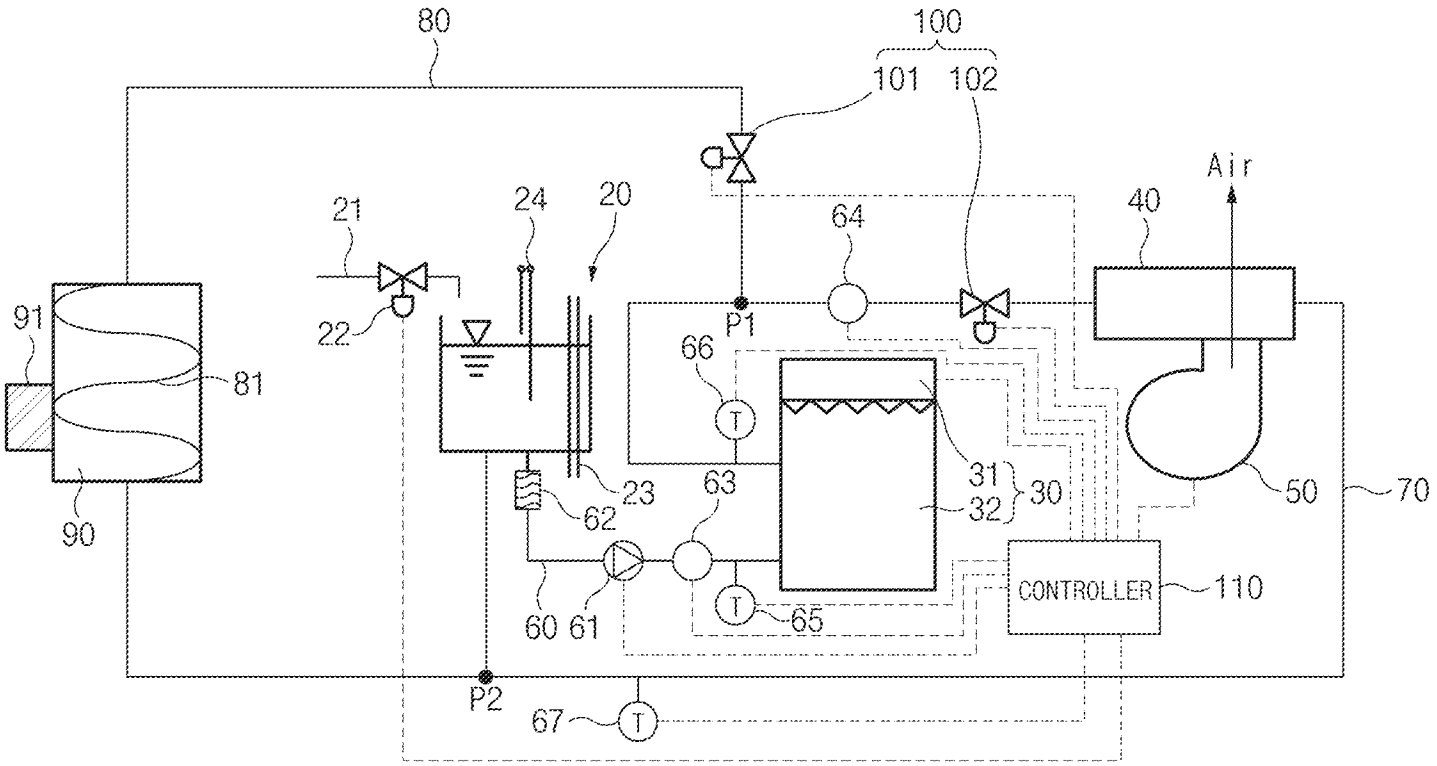
FIG. 2 is a view conceptually illustrating an air heating apparatus according to an embodiment of the present disclosure.
Figure 3:
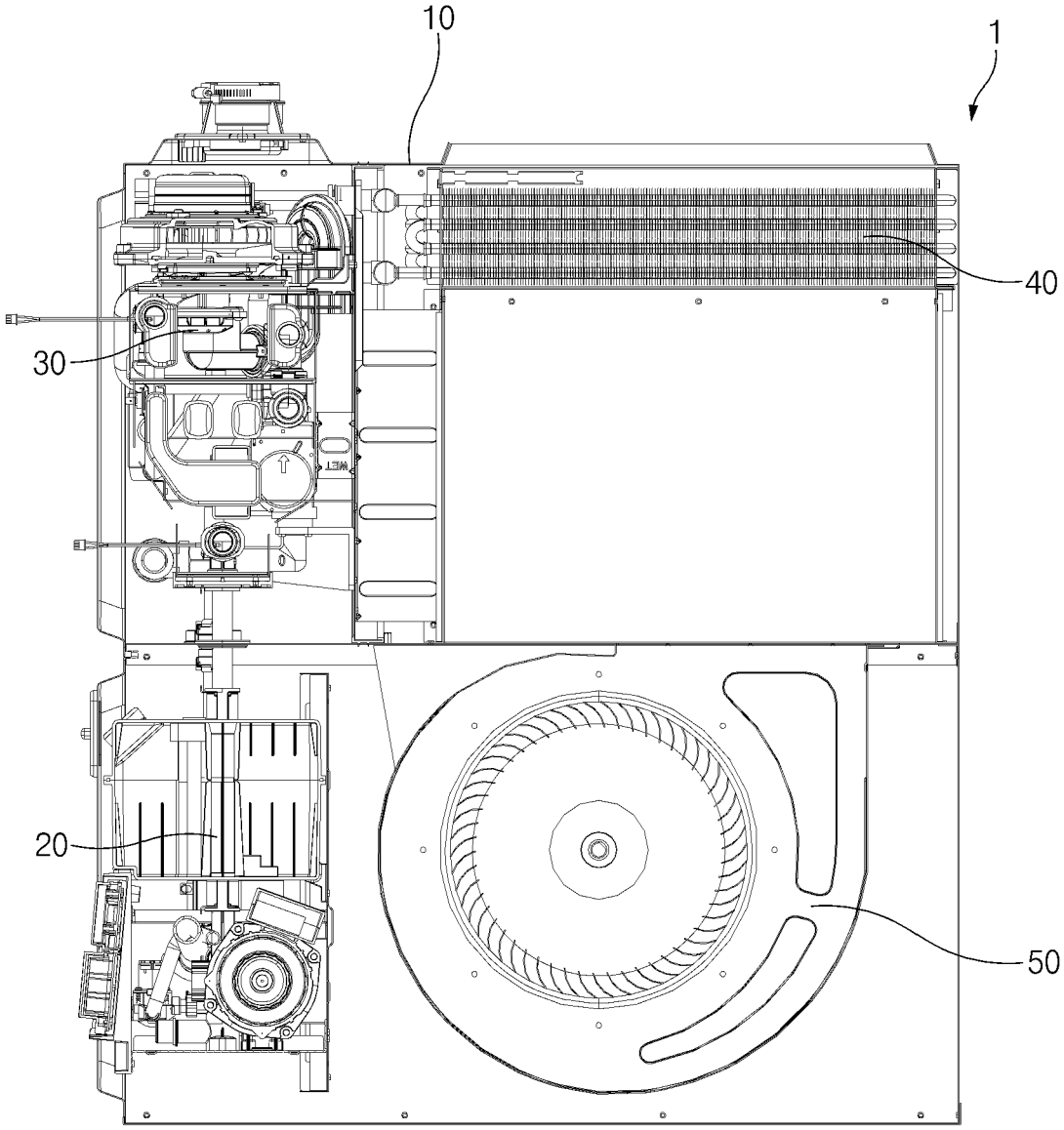
FIG. 3 is a side view of an air heating apparatus according to an embodiment of the present disclosure.

First, referring to the drawings, basic components of an air heating apparatus according to an embodiment of the present disclosure will be described in detail. FIG. 2 is a view conceptually illustrating the air heating apparatus according to an embodiment of the present disclosure. FIG. 3 is a side view of the air heating apparatus according to an embodiment of the present disclosure.

The air heating apparatus according to an embodiment of the present disclosure may include a case 10, an expansion tank 20, a water heater 30, a heating heat exchanger 40, and a fan 50. The expansion tank 20, the water heater 30, the heating heat exchanger 40, and the fan 50 may be disposed in an interior of the case 10.

In a brief description of an entire air heating mechanism, the air heating apparatus sends water preserved in the expansion tank 20 to the heating heat exchanger 40 after heating the water in the water heater 30. The heated water sent to the heating heat exchanger 40 heats air sent from the fan 50, and the heated air is delivered to rooms. Hereinafter, the components will be described in more detail.

<Expansion Tank 20>

The expansion tank 20 may be configured to preserve water. The water may be introduced from an external water source. The expansion tank 20 may be formed to accommodate a change in volume according to a change in a temperature of the water. The expansion tank 20 may be configured of an open type to accommodate a volume expansion thereof due to the water.

As illustrated in FIG. 2, the expansion tank 20 may be connected to a circulation supply passage 60. The circulation supply passage 60 may be a passage that connects the expansion tank 20, the water heater 30, and the heating heat exchanger 40. That is, the water may be introduced to the heating heat exchanger 40 from the expansion tank 20 via the water heater 30.

When a temperature of the water is changed or the water is introduced or discharged in a state, in which the water is filled in the expansion tank 20, an internal pressure of the expansion tank 20 also may be changed. Accordingly, the water accommodated in the expansion tank 20 may be provided to other components along the circulation supply passage 60.

A circulation pump 61 may be disposed in the circulation supply passage 60 on a downstream side of the expansion tank 20 and an upstream side of the water heater 30. The circulation pump 61 may be configured to pump the water in the circulation supply passage 60. The circulation pump 61 may be connected to a controller 110.

A strainer 62 may be disposed in the circulation supply passage 60. The strainer 62 may be configured to filter the water introduced into the circulation supply passage 60. The strainer 62 may be located on an upstream side of the circulation pump 61.

Furthermore, the expansion tank 20 may be connected to a circulation recovery passage 70. The circulation recovery passage 70 may be a passage that is formed to connect the heating heat exchanger 40 and the expansion tank 20 to guide the water that exchanged heat with the air in the heating heat exchanger 40 to the expansion tank 20.

Furthermore, the expansion tank 20 may be connected to a drain passage 23. The drain passage 23 may be configured to discharge the water in the expansion tank 20 to an outside. When an amount of the water in the expansion tank 20 is excessive, the water may be discharged through the drain passage 23.

A water level detecting sensor 24 that detects a water level of an interior of the expansion tank 20 may be disposed inside the expansion tank 20. The water level detecting sensor 24 may be connected to the controller 110, which will be described below.

The expansion tank 20 may be connected to a heating water supply passage 21. The heating water supply passage 21 may be configured to supply exterior water to the expansion tank 20. A heating water supplementing valve 22 that is configured to open and close the heating water supply passage 21 may be disposed in the heating water supply passage 21. The water may be supplemented through the heating water supply passage 21 when the water in the expansion tank 20 is lack.

<Water Heater 30>

The water heater 30 may be a component that is configured to heat and discharge the introduced water. The water heater 30 may cause a combustion reaction for heating the water and may transfer heat generated through the combustion reaction to the water.

The water heater 30 may include a burner 31 and a heat exchange part 32. The burner 31 causes the combustion reaction. Accordingly, the burner 31 may receive a fuel and air, and may cause the combustion reaction by forming flames in a mixture of the fuel and the air by using an ignition plug. For the operation, the burner 31 may include a blower that blows the air, a fuel nozzle that ejects the fuel, and an ignition plug that generates sparks for ignition.

The burner 31 may further include a mixing chamber, and the fuel and the air are mixed in the mixing chamber. Heat and a combustion gas are generated through the combustion reaction, and the heat and the combustion gas may be delivered to the water. The fuel may be a natural gas that includes methane and ethane to be used for generation of electric power and may be an oil, but the kinds thereof are not limited thereto. The flames generated through the combustion reaction caused by the burner 31 may be disposed in an interior space of a combustion chamber located on a lower side of the burner 31.

The heat exchange part 32 is disposed to transfer the heat generated by the burner 31 to the water. The heat exchange part 32 may be disposed on a lower side of the burner 31.

Meanwhile, the heat exchange part 32 may have an integral heat exchanger structure. The integral heat exchanger structure may mean a heat exchanger structure, in which different kinds of heat exchange media are communicated with each other. Because the heat exchange part 32 has the integral heat exchanger structure, the heat exchange part 32 may have a structure that maintains performance and has a low overall height when compared with a heat exchanger used for a general condensing boiler. Accordingly, the overall height of the water heater may become smaller in spite that an internal structure of the air heating apparatus is narrow. Accordingly, various components may be easily disposed in an interior of the air heating apparatus, and an overall size of the air heating apparatus may become smaller.

<Heating Heat Exchanger 40>

The heating heat exchanger 40 is a component that is configured to exchange heat between the water and the air. The heating heat exchanger 40 may be configured to receive water and exchange heat with the air that is to be discharged for heating.

The heating heat exchanger 40 may include a heat exchange tube, in which the water heated by the water heater 30 may flow. The heat exchange tube may have a pipe shape such that the water flows through an interior thereof and the air sent by the fan 50 flows through an outside, and may be configured to form a passage that is serpentine in a forward/rearward direction and in a leftward/rightward direction. The heat exchange tube may be formed of a material including aluminum and copper.

<Fan 50>

The fan 50 is configured to send air to the heating heat exchanger 40. As an example, as illustrated in FIG. 3, the fan 50 may be disposed on a lower side of the heating heat exchanger 40 to send the air upwards to cause the air to pass through the heating heat exchanger 40, and may be formed such that an exit, through which the air is discharged, faces an upper side. As another example, the fan 50 may be disposed on an upper side of the heating heat exchanger 40 to send the air downwards to cause the air to pass through the heating heat exchanger 40, and may be formed such that the exit, through which the air is discharged, to face a lower side.

The fan 50 may include components, such as a motor and blades, and may be electrically connected to the controller 110. Accordingly, because the fan 50 is electrically controlled to be operated, the motor may rotate the blades to send the air. The fan 50 may include an impeller to pump the air.

An air sending space that is an empty space may be formed in an interior of the case 10 between the fan 50 and the heating heat exchanger 40.

A process of circulating the air will be described below, staring from a description of the fan 50. The air introduced into the fan 50 may be sent upwards or downwards. The sent air passes through the heating heat exchanger 40. While the air passes through the heating heat exchanger 40, it may receive heat from the water that passes through the heating heat exchanger 40 to be heated. The heated air may be sent to the rooms of the house through discharge ducts. The air sent to the rooms or the cold air introduced from an outside into the interior of the house may be introduced to the fan 50 again through a suction duct. The suction duct may be formed to be communicated with the interior of the house, and may be configured to guide the interior air to the fan.

<Hot Water Heating Passage 80 and Hot Water Tank 90>

The air heating apparatus according to an embodiment of the present disclosure may include a hot water heating passage 80.

One end of the hot water heating passage 80 may be connected to a first point P1, and an opposite end thereof may be connected to a second point P2. The first point P1 may be one point that is located in the circulation supply passage 60 on a downstream side of the water heater 30. The second point P2 may be one point that is located in the circulation recovery passage 70. The hot water heating passage 80 may be configured such that the water in the circulation supply passage 60, which passed through the water heater 30, is introduced therethrough.

As an example, the hot water heating passage 80 may be a passage for heating the hot water in the hot water tank 90. Hereinafter, the hot water is water that is disposed in the hot water tank 90, and has to be regarded as water that is distinguished form the water that circulates in the air heating apparatus. In more detail, a heating area 81 of the hot water heating passage 80 may be disposed in the hot water tank 90 to heat the hot water in the hot water tank 90. Because the water heated by the water heater 30 passes through the heating passage 80, the hot water in the hot water tank 90 may be heated through the heating area 81. The heating area 81 may be formed in a spiral shape that extends downwards.

The air heating apparatus according to an embodiment of the present disclosure includes the hot water heating passage 80 and the hot water tank 90, and thus may perform both heating of the interior through heating of the air and heating of the hot water for use of the hot water.

Figure 4:
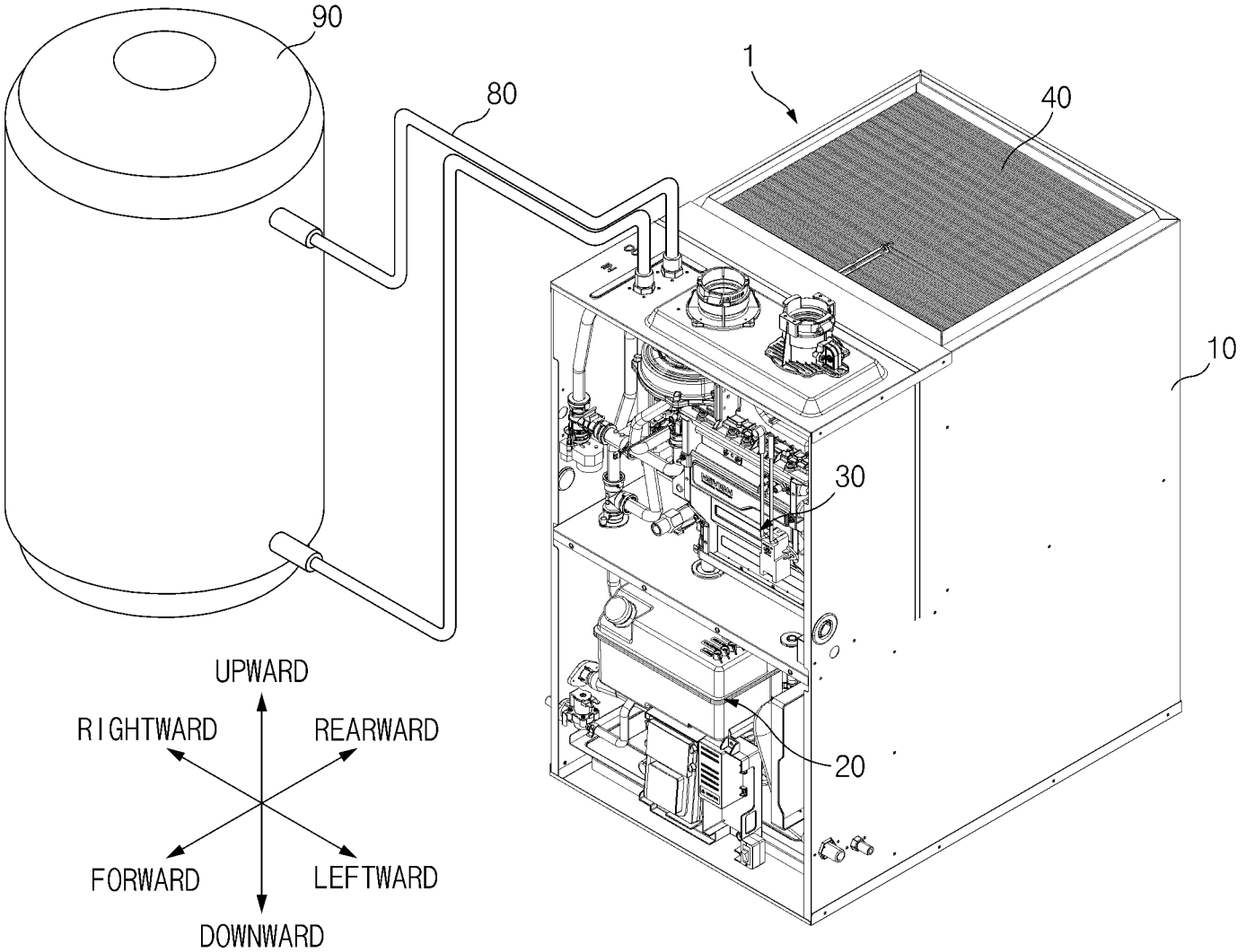
FIG. 4 is a perspective view illustrating an air heating apparatus, in which a hot water tank is disposed on a right side of a case.
Figure 5:
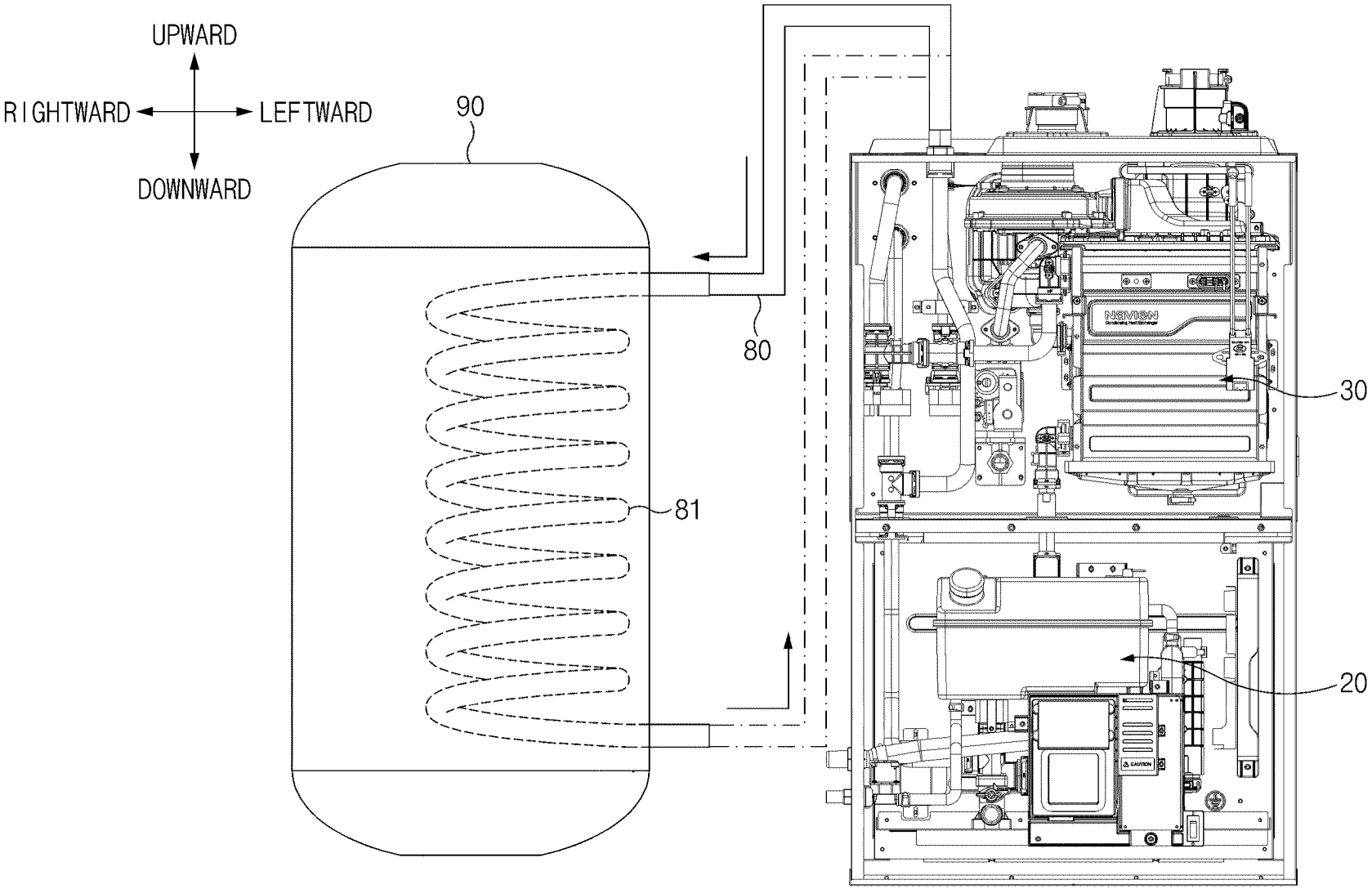
FIG. 5 is a view illustrating a state, in which the air heating apparatus of FIG. 4 is viewed from a front side.
Figure 6:
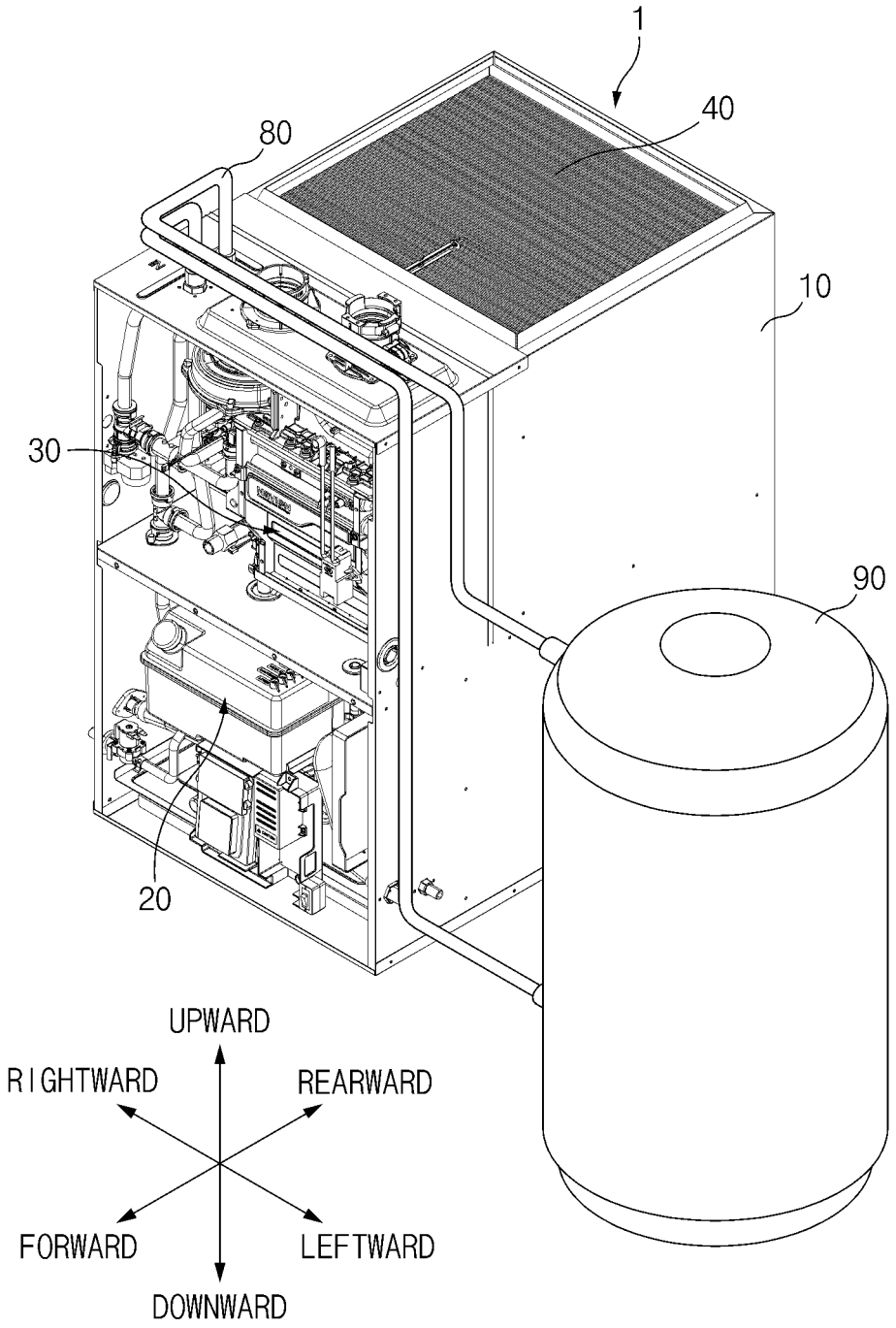
FIG. 6 is a perspective view illustrating an air heating apparatus, in which a hot water tank is disposed on a left side of a case.
Figure 7:
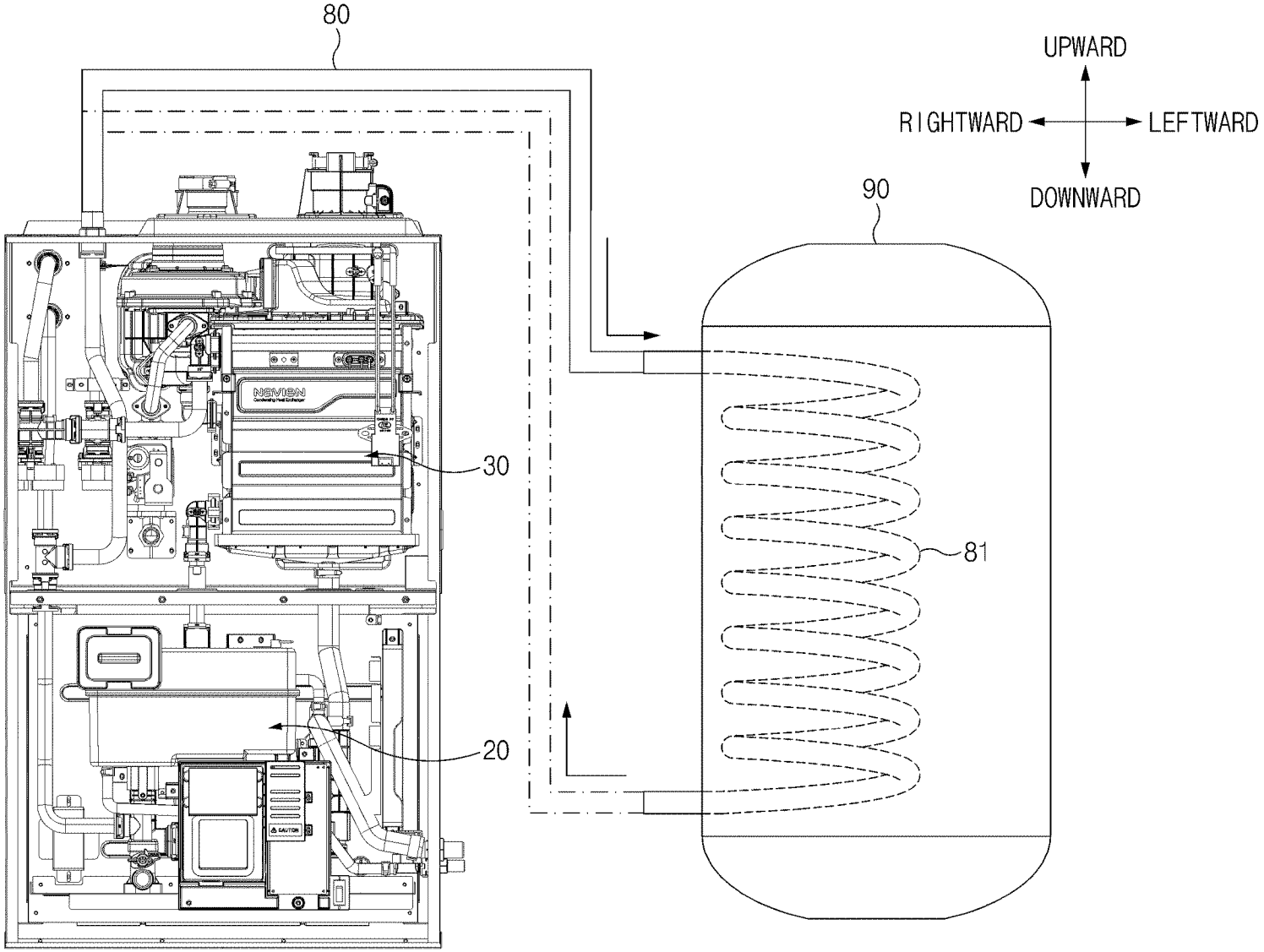
FIG. 7 is a view illustrating a state, in which the air heating apparatus is viewed from a front side.

Meanwhile, the hot water tank 90 may be disposed on a left side or a right side of the case 10 if necessary. FIG. 4 is a perspective view illustrating the air heating apparatus, in which the hot water tank is disposed on a right side of the case. FIG. 5 is a view illustrating a state, in which the air heating apparatus of FIG. 4 is viewed from a front side. FIG. 6 is a perspective view illustrating the air heating apparatus, in which the hot water tank is disposed on a left side of the case. FIG. 7 is a view illustrating a state, in which the air heating apparatus is viewed from a front side. For reference, FIGS. 4 to 7 illustrate a state, in which a front cover of the case 10 is removed. Because the hot water tank 90 may be selectively disposed on the left side or the right side of the case 10, the air heating apparatus may be easily installed.

The hot water tank 90 may be an indirect tank. This may mean that an interior of the hot water tank 90 and an interior of the hot water heating passage 80 are not communicated with each other. Furthermore, the hot water tank 90 may be a storage tank type hot water tank. However, the present disclosure is not limited thereto, and a direct water type hot water tank is also possible.

Meanwhile, as another utilized example of the hot water heating passage 80, a snow-melt system may be considered. In an area of heavy snow, snow is stacked in a parking space, such as a front yard of a house. In this case, it may be difficult to park a car in the parking space. To melt the snow stacked in the parking space, a portion of the hot water heating passage 80 may be disposed in the parking space. In this case, when the water heated by the water heater 30 is introduced into the hot water heating passage 80, the snow stacked in the parking space may be melted by the heat emitted from the hot water heating passage 80.

<Valve Part 100>

The air heating apparatus according to an embodiment of the present disclosure may further include the valve part 100. The valve part 100 may be configured to open and close the hot water heating passage 80. Furthermore, the valve part 100 may be configured to open and close a downstream side of the first point P1. Here, the opening/closing may mean an opened state that is a state, in which the water may pass through the corresponding part, and a closed state that is a state, in which the water is prevented from flowing through the corresponding part.

As an example, the valve part 100 may include a first valve 101 and a second valve 102. The first valve 101 may be disposed in the hot water heating passage 80 to open and close the hot water heating passage 80. The second valve 102 may be disposed in the circulation supply passage 60 between the first point P1 and the heating heat exchanger 40 to open and close the downstream side of the first point P1.

Opening degrees of the first valve 101 and the second valve 102 may be adjusted. An aspect that the opening degrees may be adjusted may mean that degrees, by which the valves are opened, may be adjusted. An aspect that the opening degrees of the first valve 101 and the second valve 102 may be adjusted may mean that an amount of the water introduced into the hot water heating passage 80 at the first point P1 and an amount of the water that continues to flow through the circulation supply passage 60 may be adjusted. For example, 70% of the water may be introduced into the hot water heating passage 80 and 30% of the water may be introduced into the circulation supply passage 60, and an opposite case is also possible. Furthermore, the second valve 102 may adjust a degree of heat exchange of the heating heat exchanger 40 by adjusting a flow rate of the water introduced into the heating heat exchanger 40.

Meanwhile, the valve part 100 may be variously modified in a range, in which both of the opening/closing of the hot water heating passage 80 and the opening/closing of the downstream side of the first point P1 may be performed.

<Other Components>

The air heating apparatus according to an embodiment of the present disclosure may include a first flow rate measuring part 63 and a second flow rate measuring part 64. The first flow rate measuring part 63 may be disposed on a downstream side of the circulation pump 61 and an upstream side of the water heater 30 in the circulation supply passage 60. The first flow rate measuring part 63 may be configured to measure a flow rate of the water that passes though the circulation supply passage 60. The second flow rate measuring part 64 may be disposed on a downstream side of the first point P1 in the circulation supply passage 60. The second flow rate measuring part 64 may be configured to measure a flow rate of the water that passes through the downstream side of the first point P1 in the circulation supply passage 60. The flow rate measured by the second flow rate measuring part 64 may be a flow rate of the water that is not introduced into the hot water heating passage 80 but is introduced into the downstream side of the first point P1 as the opening degrees of the first valve 101 and the second valve 102 are adjusted.

Furthermore, the air heating apparatus according to an embodiment of the present disclosure may include a first temperature measuring part 65 and a second temperature measuring part 66. The first temperature measuring part 65 may be disposed on a downstream side of the circulation pump 61 and an upstream side of the water heater 30 in the circulation supply passage 60 to measure a temperature of the water that passes through the circulation supply passage 60. The second temperature measuring part 66 may be disposed on a downstream side of the water heater 30 and an upstream side of the first point P1 in the circulation supply passage 60 to measure a temperature of the water that passes through the circulation supply passage 60. A difference between temperatures measured by the first temperature measuring part 65 and the second temperature measuring part 66 may be a difference between the temperatures of the water generated by the water heater 30.

The air heating apparatus according to an embodiment of the present disclosure may further include a third temperature measuring part 67. The third temperature measuring part 67 may be disposed in the circulation recovery passage 70 to measure a temperature of the water that passes through the circulation recovery passage 70. The third temperature measuring part 67 may be used in control logic that performs the heating mode and the hot water mode at the same time.

<Controller 110>

The air heating apparatus according to an embodiment of the present disclosure may further include the controller 110. The controller 110 may include a processor and a memory. The processor is a component that includes an element that may perform logical calculations for performing a control command, and may include a central processing unit (CPU). The processor may be connected to various components to deliver signals according to the control command to the components to perform a control and may be connected to various sensors and acquisition parts to receive the acquired signal in a form of signals. According to an embodiment of the present disclosure, the processor may be electrically connected to various components included in the air heating apparatus. Because the processor may be electrically connected to the components, it may further have a communication module that may be connected by wire or may perform communications wirelessly for mutual communications.

The processor is electrically connected to the components of the integral air heating apparatus according to an embodiment of the present disclosure to perform calculations by using the received information and deliver the control signals, and thus may control the components in an optimum state and the components may automatically interwork with each other to be operated. Furthermore, due to the integral interworking control of the processor, the information or control data acquired from the circulating water and the air as will be described below are acquired in real time and controlled in an integrated way, and thus a uniform efficiency may be maintained and optimum setting that is suitable for an entire system may be automatically made.

The control commands performed by the processor may be stored in the memory to be utilized. The memory may be a device, such as a hard disk drive (HDD), a solid state drive (SSD), a server, a volatile medium, or a nonvolatile medium, but the kind thereof is not limited thereto. In addition, data that are necessary for the processor to pertain an operation may be further stored in the memory.

The controller 110 may be electrically connected to the valve part 100 to control an operation of the valve part 100. Similarly, the controller 110 may be configured to control operations of the water heater 30, the fan 50, and the circulation pump 61. Furthermore, the controller 110 may acquire information on the flow rates of the water from the first flow rate measuring part 63 and the second flow rate measuring part 64, and may acquire the information of the temperatures of the water from the first to third temperature measuring parts 65, 66, and 67.

<Hearing Mode>

Figure 8:
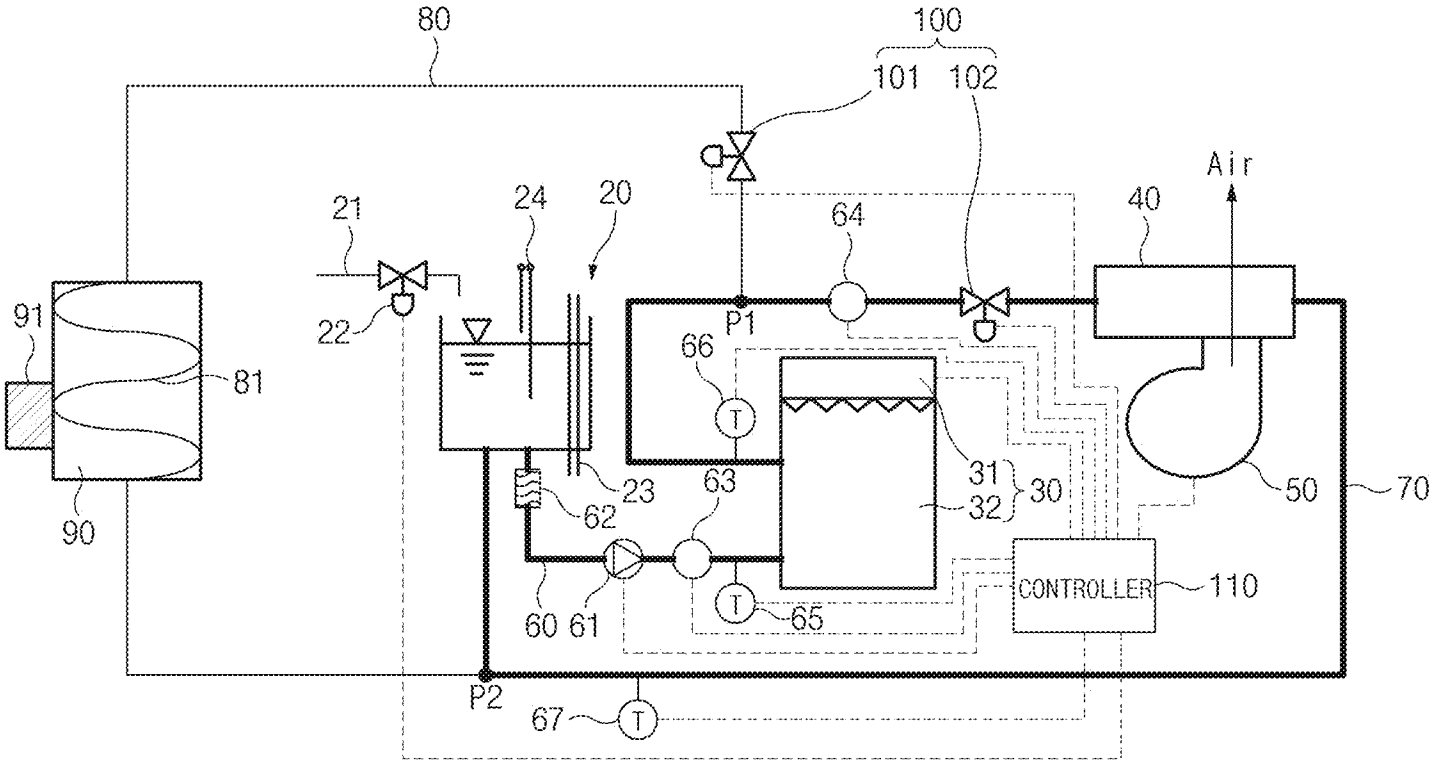
FIG. 8 is a view illustrating a state, in which an air heating apparatus according to an embodiment of the present disclosure performs a heating mode.

FIG. 8 is a view illustrating a state, in which the air heating apparatus according to an embodiment of the present disclosure performs the heating mode. Hereinafter, an operation of the controller 110 in the heating mode will be described in detail. Then, it is assumed that the hot water mode is not performed. For reference, it may be understood that a thick line in FIG. 8 indicates a flow of the water.

The controller 110 may control the valve part 100 to open the downstream side of the first point P1 and close the hot water heating passage 80. This may mean that the controller 110 controls the valve part 100 such that the first valve 101 is in a closed state and the second valve 102 is in an opened state.

The controller 110 may perform a combustion calorie proportional control. This may mean that operations of the water heater 30, the fan 50, and the circulation pump 61 are controlled such that, after a measured temperature and a target temperature are compared and a difference thereof is fed back such that a combustion calorie that are necessary is delivered to a targeted location.

As an example, the controller 110 may perform a calorie proportional control based on a temperature of the water, which is measured by the third temperature measuring part 67. For example, when the temperature of the water, which is measured by the third temperature measuring part 67, does not reach the targeted temperature, the controller 110 may further increase the combustion calorie of the water heater 30.

As another example, the controller 110 may perform a calorie proportional control based on the interior air disposed in the interior of the room. For example, when a temperature of the air, which is acquired by an interior air temperature measuring part disposed in the interior does not reach a targeted interior temperature, the controller 110 may further increase the combustion calorie of the water heater 30.

<Hot Water Mode>

Figure 9:
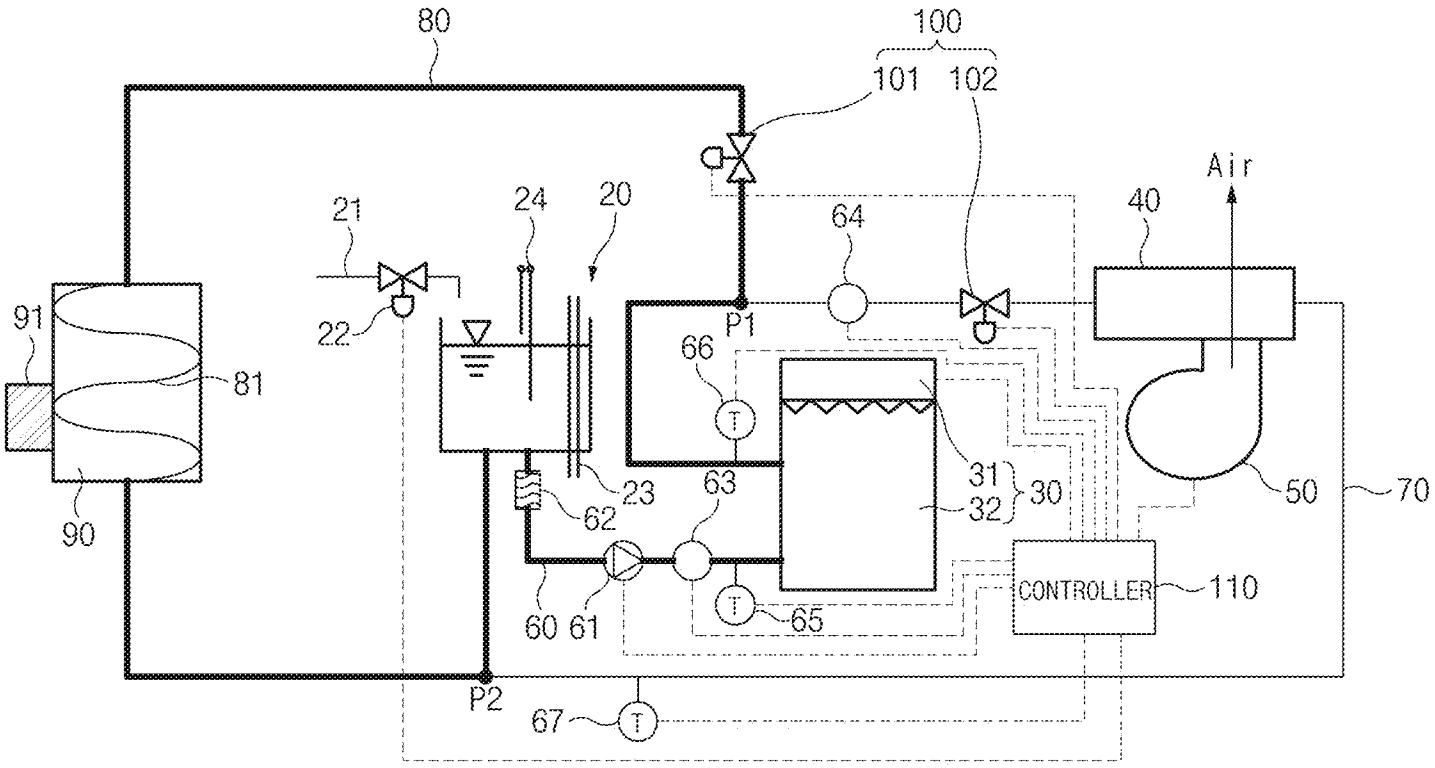
FIG. 9 is a view illustrating a state, in which an air heating apparatus according to an embodiment of the present disclosure performs a hot water mode.

FIG. 9 is a view illustrating a state, in which the air heating apparatus according to an embodiment of the present disclosure performs the hot water mode. Hereinafter, an operation of the controller 110 in the hot water mode will be described in detail. Then, it is assumed that the heating mode is not performed. For reference, it may be understood that a thick line in FIG. 9 indicates a flow of the water. Furthermore, hereinafter, a case, in which the hot water tank 90 is included, will be described in detail, but the flow of the water also may be applied in the same way when the hot water heating passage 80 is used for a snow-melt system.

The controller 110 may control the valve part 100 such that the downstream side of the first point P1 is closed and the hot water heating passage 80 is opened. That means that the controller 110 controls the valve part 100 such that the first valve 101 corresponds to an opened state and the second valve 102 corresponds to a closed state.

With reference to the flows of the water in the hot water mode, the water introduced into the circulation supply passage 60 is introduced into the circulation recovery passage 70 again at the second point P2 after passing through the water heater 30 and being introduced into the hot water heating passage 80 at the first point P1.

Meanwhile, a hot water temperature measuring part 91 may be disposed in the hot water tank 90. The hot water temperature measuring part 91 may be coupled to the hot water tank 90 and may be electrically connected to the controller 110. The hot water temperature measuring part 91 may be configured to deliver the information on the acquired temperature of the hot water in the hot water tank 90 to the controller 110.

Meanwhile, the controller 110 also may perform a combustion calorie proportional control on the hot water. The controller 110 may control operations of the water heater 30 and the circulation pump 61 based on a value obtained by comparing a temperature of the hot water, which is acquired by the hot water temperature measuring part 91 and a target hot water temperature. For example, when the temperature of the hot water, which is acquired by the hot water temperature measuring part 91, is lower than the target hot water temperature, it is necessary to further heat the hot water, and thus the water heater 30 may be operated such that a degree of combustion of the burner 31 increases. In this case, the water further heated through the water heater 30 may be introduced into the hot water heating passage 80 whereby the temperature of the hot water in the hot water tank 90 may increase.

<When Heating Mode and Hot Water Mode Are Performed at the Same Time>

Figure 10:
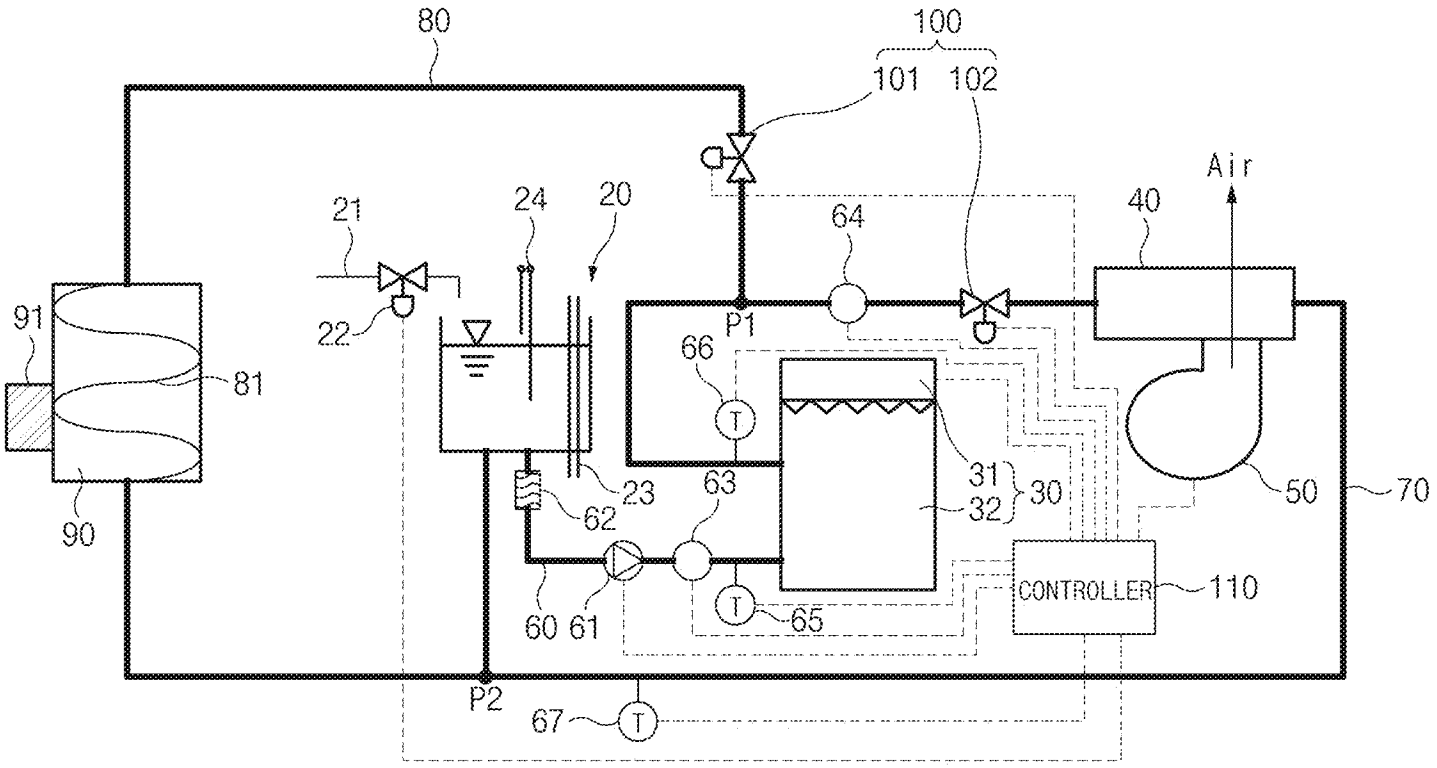
FIG. 10 is a view illustrating a state, in which an air heating apparatus according to an embodiment of the present disclosure performs both of a heating mode and a hot water mode.

FIG. 10 is a view illustrating a state, in which the air heating apparatus according to an embodiment of the present disclosure performs both of the heating mode and the hot water mode. Hereinafter, an operation of the controller 110 when both of the heating mode and the hot water mode are performed will be described in detail. The case corresponding to both of the heating mode and the hot water mode is different from the heating mode and the hot water mode in that both of the first valve 101 and the second valve 102 are in opened states.

The controller 110 may control the first valve 101 to open the hot water heating passage 80. Furthermore, the controller 110 may control the second valve 102 to open the downstream side of the first point P1.

Furthermore, when the heating mode, in which the interior of the room is heated, and the hot water mode are performed together, the controller 110 may control the second valve 102 to decrease the flow rate of the water that flows to the downstream side of the first point P1.

Then, the controller 110 may control the first valve 101 and the second valve 102 to control at least any of the opening degree of the first valve 101 or the opening of the second valve 102 based on a value obtained by comparing a temperature of the hot water, which is acquired by the hot water temperature measuring part 91, and a target hot water temperature. The water, except for the water for acquiring the temperature of the necessary hot water may be sent to the heating heat exchanger 40, through the control.

According to the present disclosure, because the air heating apparatus that may perform a heating function further includes the hot water heating passage 80 connected to the hot water tank 90, the hot water heating function may be additionally performed. Accordingly, as compared with a case, in which the air heating apparatus and the hot water heating apparatus are separately provided, a spatial utility may be enhanced and costs may be reduced.

OTHER EMBODIMENTS

Figure 11:
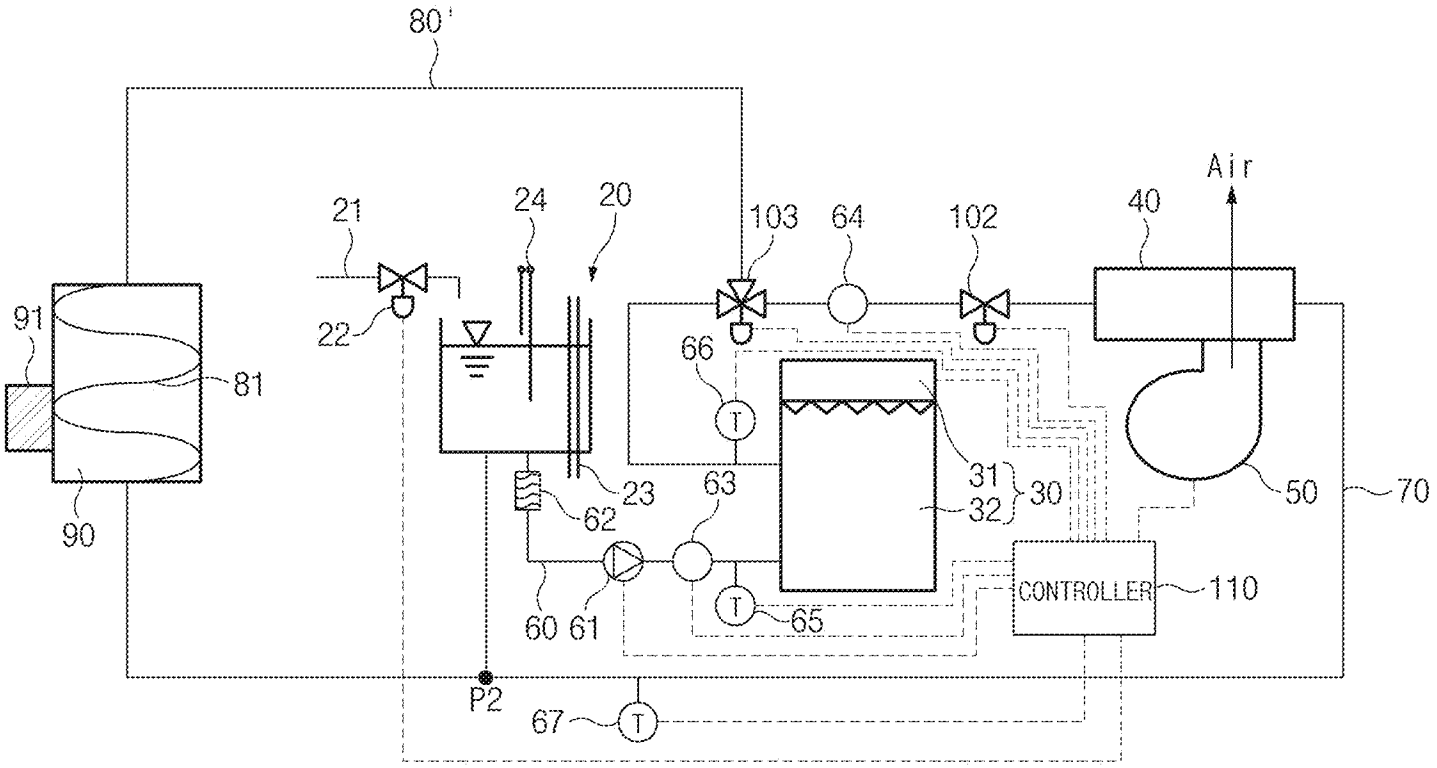
FIG. 11 is a view conceptually illustrating an air heating apparatus according to another embodiment of the present disclosure.
Figure 12:
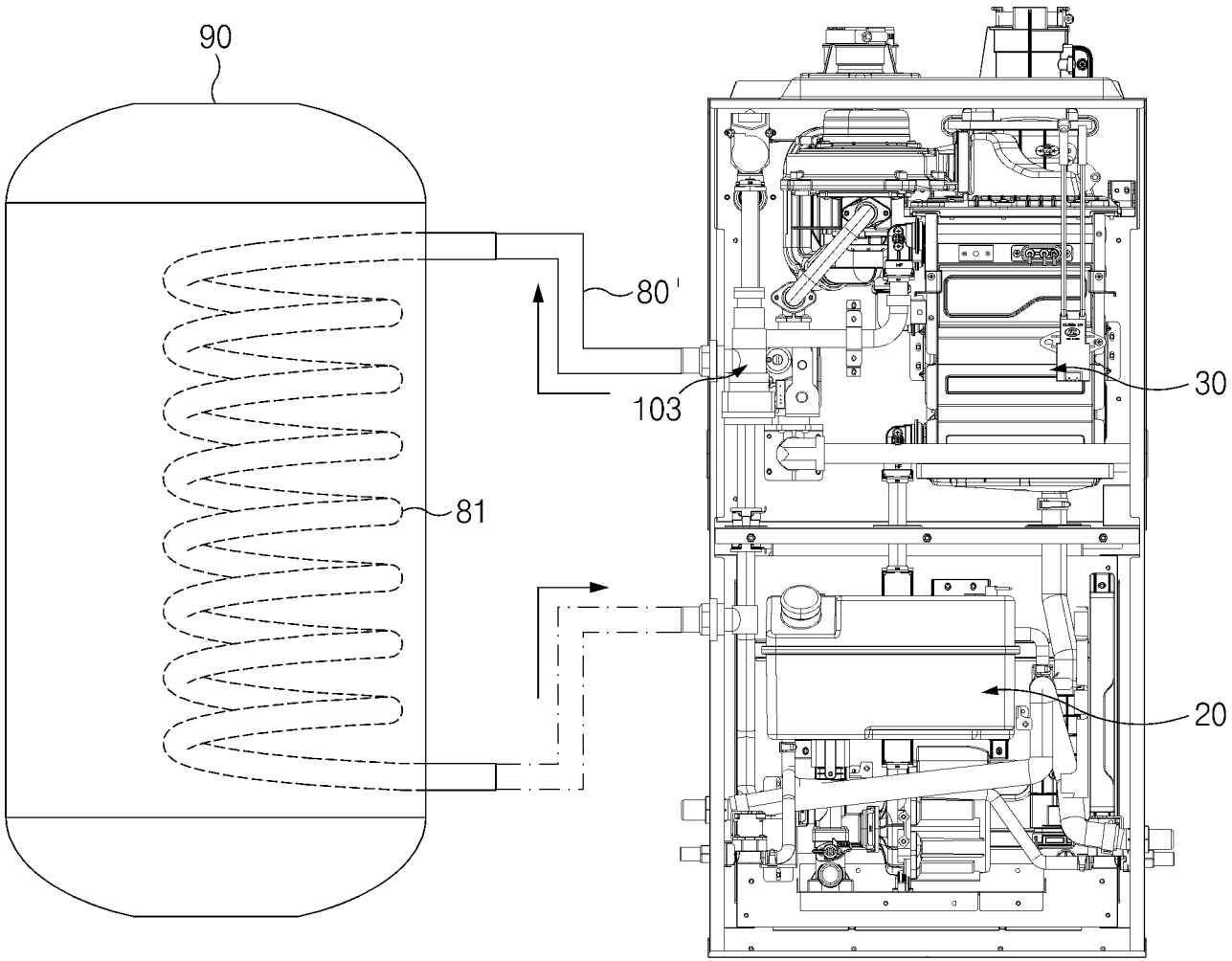
FIG. 12 is a view illustrating a state, in which an air heating apparatus according to another embodiment of the present disclosure is viewed from a front side.

Hereinafter, an air heating apparatus according to another embodiment of the present disclosure will be described in detail with reference to FIGS. 11 and 12. FIG. 11 is a view conceptually illustrating the air heating apparatus according to another embodiment of the present disclosure. FIG. 12 is a view illustrating a state, in which the air heating apparatus according to another embodiment of the present disclosure is viewed from a front side.

The air heating apparatus according to the another embodiment of the present disclosure is different in that the valve part 100 includes a 3-way valve 103 instead of the first valve 101. The configurations that are the same as or correspond to those of the air heating apparatus according to an embodiment of the present disclosure are endowed with the same or corresponding reference numerals, and a detailed description thereof will be omitted.

The valve part 100 may further include the 3-way valve 103. Then, the 3-way valve 103 may be disposed at the first point P1. The 3-way valve 103 may include an inlet that is connected to an upstream side of the first point P1, a first outlet that is connected to a hot water heating passage 80', and a second outlet that is connected to a downstream side of the first point P1. It may be understood that the hot water heating passage 80 is opened when the first outlet is opened. Furthermore, it may mean that the downstream side of the first point P1 is opened and thus the water may be introduced into the heating heat exchanger 40 through the circulation supply passage 60 when the second outlet is opened.

The 3-way valve 103 may adjust opening degrees of the first outlet and the second outlet. As an example, 50% of the water may be introduced into the hot water heating passage 80' through the first outlet, and the remaining 50% of the water may be introduced to the downstream side of the first point P1 and may be introduced into the heating heat exchanger 40.

Meanwhile, according to the air heating apparatus according to another embodiment of the present disclosure, the valve part 100 includes the 3-way valve 103, the hot water heating passage 80 may not be disposed to pass through an upper side of the case 10 but may be disposed to pass through a side surface of the case 10 as illustrated in FIG. 12, in consideration of a structure of the 3-way valve 103.

According to the present disclosure, because the hot water heating function may be additionally performed through the hot water heating passage connected to the hot water tank, a spatial utility may be enhanced and costs may be reduced as compared with the case, in which the air heating apparatus and the hot water heating apparatus are separately provided.

The above description is a simple exemplification of the technical spirits of the present disclosure, and the present disclosure may be variously corrected and modified by those skilled in the art to which the present disclosure pertains without departing from the essential features of the present disclosure. Accordingly, the embodiments disclosed in the present disclosure is not provided to limit the technical spirits of the present disclosure but provided to describe the present disclosure, and the scope of the technical spirits of the present disclosure is not limited by the embodiments. Accordingly, the technical scope of the present disclosure should be construed by the attached claims, and all the technical spirits within the equivalent ranges fall within the scope of the present disclosure.

What is claimed is:

1. An air heating apparatus comprising:

an expansion tank configured to preserve water;

a water heater configured to receive heat from a combustion gas generated through a combustion reaction to heat the water;

a heating heat exchanger configured to receive the water heated by the water heater and exchange heat with air that is to be discharged for heating;

a fan configured to send the air to the heating heat exchanger;

a circulation supply passage configured to connect the expansion tank, the water heater, and the heating heat exchanger to guide the water in the expansion tank to the heating heat exchanger via the water heater;

a circulation recovery passage formed to connect the heating heat exchanger and the expansion tank to guide the water that exchanged heat with the air to the expansion tank; and a hot water heating passage, one end of which is connected to a first point that is one point of the circulation supply passage, which is located on a downstream side of the water heater, an opposite end of which is connected to a second point that is one point of the circulation recovery passage, and through which the water in the circulation supply passage that passed through the water heater is introduced.

2. The air heating apparatus of claim 1, further comprising:

a valve part configured to open and close the hot water heating passage, and configured to open and close a downstream side of the first point.

3. The air heating apparatus of claim 2, wherein the valve part includes:

a first valve disposed in the hot water heating passage and configured to open and close the hot water heating passage; and a second valve disposed between the first point of the circulation supply passage and the heating heat exchanger, and configured to open and close a downstream side of the first point.

4. The air heating apparatus of claim 3, wherein opening degrees of the first valve and the second valve are adjustable.

5. The air heating apparatus of claim 3, further comprising:

a circulation pump disposed in the circulation supply passage between a downstream side of the expansion tank and an upstream side of the water heater, and configured to pump the water in the circulation supply passage.

6. The air heating apparatus of claim 5, further comprising:

a first flow rate measuring part disposed in the circulation supply passage between a downstream side of the circulation pump and the upstream side of the water heater, and configured to measure a flow rate of the water that passes through the circulation supply passage; and a second flow rate measuring part disposed in the circulation supply passage on the downstream side of the first point, and configured to measure a flow rate of the water that passes in the circulation supply passage on the downstream side of the first point.

7. The air heating apparatus of claim 5, further comprising:

a first temperature measuring part disposed in the circulation supply passage between a downstream side of the circulation pump and the upstream side of the water heater, and configured to measure a temperature of the water that passes through the circulation supply passage; and a second temperature measuring part disposed in the circulation supply passage on the downstream side of the water heater and an upstream side of the first point, and configured to measure a temperature of the water that passes through the circulation supply passage.

8. The air heating apparatus of claim 3, further comprising:

a third temperature measuring part disposed in the circulation recovery passage, and configured to measure a temperature of the water that passes through the circulation recovery passage.

9. The air heating apparatus of claim 4, further comprising:

a controller electrically connected to the valve part, and configured to control an operation of the valve part.

10. The air heating apparatus of claim 9, wherein in a hot water mode, in which it is necessary to use hot water, the controller controls the first valve to open the hot water heating passage.

11. The air heating apparatus of claim 10, wherein when, in a heating mode for heating an interior, the heating mode and the hot water mode, in which it is necessary to use the hot water, are performed together, the controller controls the second valve to decrease a flow rate of the water that flows to the downstream side of the first point.

12. The air heating apparatus of claim 11, further comprising:

a hot water tank provided with a heating area of the hot water heating passage in an interior thereof, and in which the hot water is preserved; and a hot water temperature measuring part coupled to the hot water tank and electrically connected to the controller, and configured to deliver acquired information on a temperature of the hot water in the hot water tank to the controller, wherein the controller is configured to control the first valve and the second valve to control at least any one of an opening of the first valve or the second valve, based on a value obtained by comparing a temperature of the hot water, which is acquired by the hot water temperature measuring part, and a target hot water temperature.

13. The air heating apparatus of claim 1, further comprising:

a hot water tank, in which hot water is preserved, wherein a heating area of the hot water heating passage is disposed in the hot water tank to heat the hot water in the hot water tank.

14. The air heating apparatus of claim 13, wherein the heating area is formed to have a spiral shape that extends downwards.

15. The air heating apparatus of claim 13, wherein an interior of the hot water tank and an interior of the hot water heating passage are not communicated with each other.

* * * * *